United States Patent [19]

Dow et al.

[11] 4,134,951

[45] Jan. 16, 1979

[54] PRODUCTION OF FILAMENTS

[75] Inventors: James Dow, Thaxted; Ronald Lloyd, Sawbridgeworth; Albert G. Patchell, Welwyn Garden City, all of England

[73] Assignee: Smith & Nephew Polyfabrik Limited, Nelson, England

[21] Appl. No.: 771,097

[22] Filed: Feb. 23, 1977

Related U.S. Application Data

[63] Continuation of Ser. No. 176,558, Aug. 31, 1971, abandoned, which is a continuation-in-part of Ser. No. 803,649, Mar. 3, 1964, abandoned.

[51] Int. Cl.[2] ..... B32B 3/10

[52] U.S. Cl. ..... 264/147; 264/175; 264/210 R; 264/284; 264/288; 264/DIG. 47

[58] Field of Search ..... 264/147, 210 F, DIG. 47, 264/175, 210 R, 284, 288, 146

[56] References Cited

U.S. PATENT DOCUMENTS

| | | | |
|---|---|---|---|
| 2,327,087 | 8/1943 | Austin | 264/147 |
| 3,357,773 | 12/1967 | Rowland | 264/1 |
| 3,478,138 | 11/1969 | Friesner | 264/145 |
| 3,515,778 | 6/1970 | Fields et al. | 264/147 |
| 3,567,545 | 3/1971 | Bobkowicz et al. | 156/229 |
| 3,594,870 | 7/1971 | Schirvers et al. | 264/DIG. 47 |
| 3,746,607 | 7/1973 | Harmon et al. | 264/147 |
| 3,810,729 | 5/1974 | Patchell | 264/147 |
| 3,851,034 | 11/1974 | Harmon et al. | 264/147 |
| 3,981,952 | 9/1976 | Ruddell et al. | 264/289 |
| 3,983,202 | 9/1976 | Skoroszewski | 264/210 R |

FOREIGN PATENT DOCUMENTS

| | | | |
|---|---|---|---|
| 726089 | 1/1966 | Canada | 264/175 |

*Primary Examiner*—Jay H. Woo

*Attorney, Agent, or Firm*—Robert L. Goldberg; David G. Conlin

[57] ABSTRACT

An extruded sheet or the like of cold-drawable polymer such as polypropylene is embossed as a molten sheet by a circumferentially multi-grooved roller and stretched in the direction of the embossed grooves to split into filaments along the grooves.

28 Claims, 18 Drawing Figures

Figure 10:
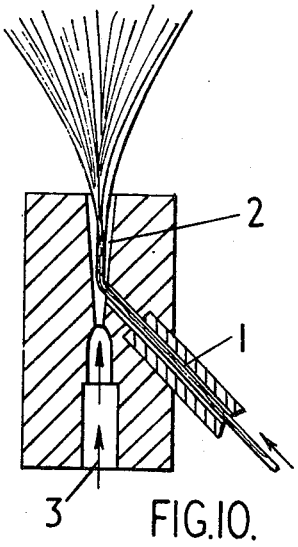

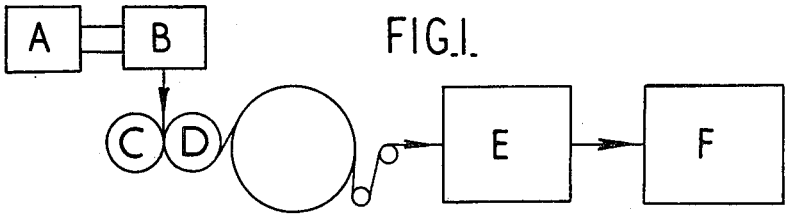
FIG.1.
FIG.2.
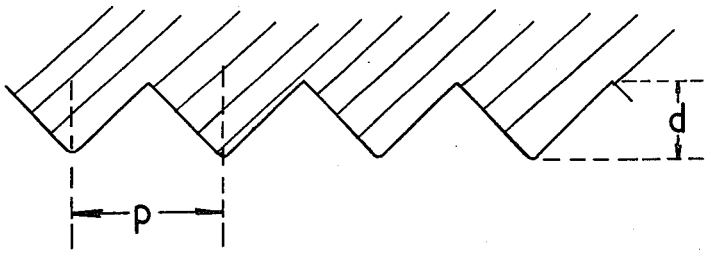
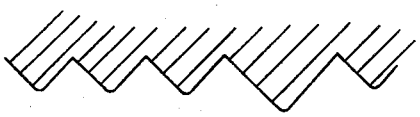
FIG.3.
FIG.4.
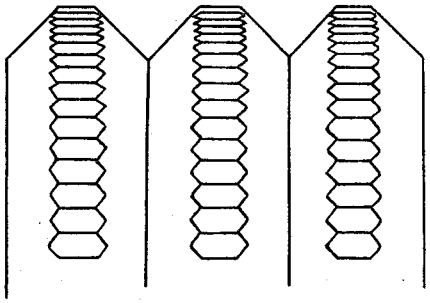

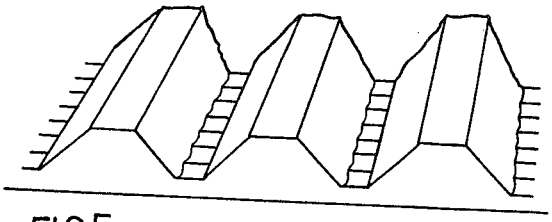
FIG.5
FIG.6a.
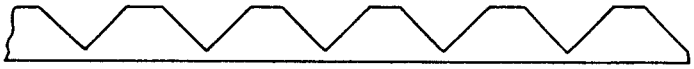
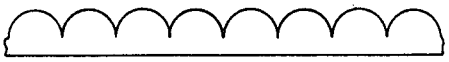
FIG.6b.
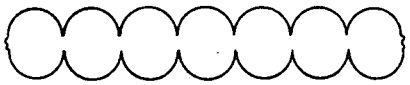
FIG.6c.
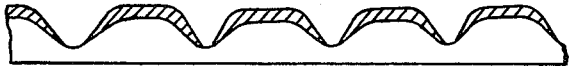
FIG.7a.
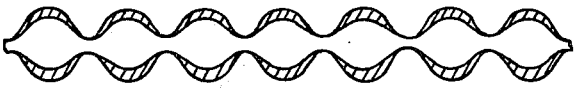
FIG.7b.
FIG.8.
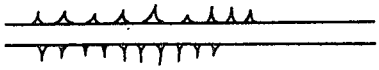
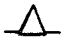
FIG.9a.
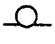
FIG.9b.
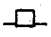
FIG.9c.

PRODUCTION OF FILAMENTS

This is a continuation of application Ser. No. 176,558, filed Aug. 31, 1971 now abandoned, which is a continuation-in-part of Ser. No. 803,649 filed Mar. 3, 1964, now abandoned.

This invention relates to the production of fibrous material (staple, monofilament or yarn, etc.) from a stretched sheet of melt-embossed cold drawable polymeric material. A commercial product with which the invention is primarily concerned is a multifilament yarn, optionally partially joined between the filaments. The invention also relates to the melt-embossed sheet itself and to intermediate products such as tapes slit from such a sheet.

Throughout this specification the terms "film" and "sheet" are used to mean the same thing, notwithstanding certain commercial usages where "sheet" may be a discrete length of relatively heavy guage.

In certain applications filaments are used as such but in other applications, where textile-like properties are required, bundles of monofilaments are cut into short staple lengths and spun into yarns. Of course, the long monofilaments themselves may be twisted into yarn also.

Monofilaments produced from many different types of polymers are known. These monofilaments are generally produced by extruding polymer through an orifice followed by subsequent uniaxial orientation. The shape of the cross-section along the monofilament remains constant.

It is known that when crystalline polymer films are slit into tapes and highly oriented, filaments of high tensile strength are produced. Tape filaments made in this way tear very easily in the direction of orientation and will fibrillate continuously in this direction.

We have now found that polymer sheet in a molten state, e.g. when extruded as a sheet from a slit die, cast on a roller having fine continuous circumferential grooves to form a complementarily ribbed and grooved sheet, when highly oriented in the direction of the sheet grooves, splits in a continuous controlled manner along each furrow formed by the embossing roller to produce filaments. It will be appreciated that the roller grooves should be individual annular grooves and not follow a continuous helical thread to avoid breakaway of filaments from the edge of the sheet.

In one aspect the present invention therefore provides a process for the production of continuous filaments comprising passing a molten deformable polymeric material as a preformed flat extended area and as a hot melt into the nip formed between (a) at least one roller having a multiplicity of adjacent fine continuous circumferential grooves and (b) a second roller in contact therewith, at least one of said rollers being maintained at a temperature below the temperature of the molten deformable polymeric material to effect cooling and form a flat body of material having parallel continuous ribs; stretching the ribbed material in a direction substantially parallel to the ribs by an amount sufficient to orient the polymer; and splitting the material between the ribs to form longitudinal filaments corresponding to said ribs.

It is usually envisaged to extrude as a sheet and slit the sheet into a plurality of tapes before, during or after embossing or stretching.

Under some circumstances the sheet or the tapes slit from it will readily split between the ribs spontaneously on stretching. Usually, however, some form of transverse stress needs to be effected on the stretched sheet to assist splitting.

The sheet is embossed on the roller when it is a hot melt immediately after being extruded. The process of the invention differs therefore from known processes in which a plurality of longitudinally ribbed tapes are formed by extrusion through a suitably profiled die and thereafter stretched and twisted into yarn. Such processes are disclosed in British Patents Nos. 1,035,657 and 1,134,243 and in Belgian Patent No. 702,966. The essential different in the present process is that a flat sheet, e.g. as extruded through a simple split, is melt-embossed by a roller with longitudinal grooves and ribs.

A consequence of the process of the invention is that the filaments produced by drawing the melt-embossed grooved sheet have not only less variation in denier and physical properties than those produced by random fibrillation of a non-embossed sheet, but also than the fibres produced from the processes using profiled dies so that the fibres produced according to the invention approximate more closely to the regular fibres produced by conventional filament extrusion processes.

Having now discussed in outline the production of filaments by the process according to the invention, it is convenient to discuss the preferred features of the invention. These can be considered as:

(i) Nature of Polymer Material

Normally the polymeric material is a "cold-drawing polymer" (i.e. a polymer which will extend by drawing below the melting temperature of the crystallites) which readily undergoes deformation and orientation on stretching and retains its permanent set. Thermoplastic materials that may be used include (1) polyolefins, such as high desnity polyethylene (HD), polypropylene (PP) the "1-olefins" such as poly (methyl-4-pentene-1) and the olefin copolymers such as ethylene/propylene and propylene/butylene copolymers, (ii) polyamides such as nylon -6 nylon -66 and nylon -6,10, (iii) polyesters such as polyethylene terephthalate, and homogeneous blends and mixtures of these compounds. It will be appreciated that the chemical inertness to water, to many solvents and to micro-organisms makes the polyolefin fibres in particular especially valuable for industrial applications. In practice, as is conventional, various fillers, pigments, flame retardants, antioxidants, etc. can be incorporated.

(ii) Extrusion of Sheet

A preferred method of providing the sheet for melt embossing is extrusion through a slit die, at a die lip setting from 0.005 inches to 0.060 inches, and with a slit from 5 to 40 inches wide. This extrusion can be effected at any convenient temperature, e.g. for polypropylene from 200° to 300° C. Of course, the melt draw down will ensure that the sheet entering the nip of the rollers is appreciably less thick than the die lip setting and will also ensure a certain amount of melt orientation. From 200 to 1000 percent drawing is particularly preferred although not essential.

(iii) Nature of Embossing

The rollers through which the sheet is passed can have various forms. Preferred forms are:

(a) A single grooved roller in pressure contact with a smooth, cooled, stainless steel or "Hypalon" rubber roller, (b) Two grooved rollers in pressure contact, which is a preferred arrangement. These can impress a pattern on each side simultaneously. This pattern can be of two longitudinal sets of grooves, preferably coincident, although on opposite sides, but possibly out-of-phase with one another. Possibly the grooves can be longitudinal on one side and be shallow transverse grooves on the other, (c) A combination of arrangement (a) with an additional patterned roller, e.g. to provide shallow transverse grooves over the longitudinal grooves, (d) A combination of arrangement (a) or (b) with an additional patterned roller impressing on occasional subdividing groove into the sheet.

The rollers can rotate at the same speed or at slightly different speeds. They can also have the same or different temperatures, e.g. so as to effect secondary embossing using a hot roller; of course, at least one of the rollers will be cooler than the molten film entering the nip in order to cool the film to a more or less solid form capable of being handled. Thus, either the grooved roller, or any smooth backing roller, or both, can be cooled.

(iv) Nature of Embossing Roller

The pitch and depth of grooves on the roller will depend on the filament denier required. The number of grooves may vary from 10 to 500 per inch width, particularly 10 to 300 per inch. The grooves on the roller are generally deeper than the ridges formed in the polymer sheet, since the polymer sheet need not completely fill the grooves.

The cross-section of the grooves can be generally triangular, rectangular or half-round. It will be appreciated that opposed rollers preferably with grooves semicircular in cross-section will produce a sheet giving rounded monofilaments. This is a preferred feature. The particular cross-section is chosen according to the end product required.

Ridges on the embossing roller may be engraved with a relief pattern which is transferred to the furrows of the embossed sheet, so that transverse fibrillation occurs in the furrows on stretching. The grooves of the embossing roller may also carry a finely engraved pattern for texturing the filaments produced.

It is possible to provide an occasional high ridge on a roller to give subdivision of the sheet, especially if there is a cooperating groove on the opposing roller.

(v) Nature of the Film Leaving the Rollers

The thickness of the film will depend on the denier of filament desired. Suitable film thickness may vary from 0.001 to 0.020 inch particularly about 0.002 to 0.010 inch. For convenience in considering the specific examples, it will be necessary to bear in mind that 0.001 inches = 25$\mu$.

The material between the ridges, i.e. the connecting membrane, is as thin as possible and is usually less than 50% of the total sheet thickness after roller, and frequently less than 10%. In absolute terms, a thickness of this membrane of less than 20$\mu$ is of particular value.

For a given embossing roller, it should be noted that a thinner film gives a flattish monofilament (since it does not penetrate into the bottom part of the grooves) whereas a thicker film in relation to the grooves gives a rounder monofilament.

(vi) Primary Subdivision

The sheet is usually divided into tapes for convenient handling. The tapes contain a number of grooves, e.g. 25, 35 or 50 grooves, and it is an advantage of the invention that tapes of different numbers of grooves readily be produced without expensive alterations to the die. Subdivision can be effected as:

(i) subdivision at the die lips usually after extrusion as a sheet, (ii) subdivision by roller ridges while the sheet is passing through the nip of the rollers, (iii) subdivision after embossing, and preferably before stretching (a) with a separate subdividing roller either by pressure or by shear i.e. "scissor-cutting"

(b) cutting means such as knives or pins (c) shear slitting e.g. "trouser-leg" toaring These methods can be effected before, during or after stretching.

(vii) Preferred Stretching Conditions

The degree of stretching of the film in the direction of the ribs, and conditions in which stretching is carried out will vary depending on the polymeric material, the denier required, the thickness of the film, the configuration of the ribs and the products required. For example, the degree of stretching for producing filaments from polypropylene may vary up to 2000% and usually extends from 500% - 1500%. The stretch for other polymers may be greater or less depending on their natural draw ratio.

The temperature of stretching depends on the polymer.

In general it will lie within the range from ambient temperature to 250° C. Polypropylene will stretch at 130° - 155° C especially at about 150° C.

Stretching can be effected in more than one stretching stage and at different temperatures in each stage.

It is of value for the stretching to be carried out without lateral restraint if a sheet is stretched. If a sheet is stretched between gripping means which are too close together having regard to the sheet width thereby giving partial lateral restraint, it will neck down while still in the proximity of one of them, and the edges of the sheet will not be drawn to the same extent as the centre of the sheet, giving a different rib pitch and eventually different fibre denier. However, if the sheet is stretched in free flight it necks down in unrestrained conditions and can corrugate bodily to ensure that the uniformity of spacing of the ridges is maintained and that all ribs are eventually the same thickness.

Of course, if the sheet is slit before stretching, as is preferable in practice, this difficulty does not arise.

However, complete lateral restraint, e.g. by a cascade of closely adjacent stretching rollers should also maintain pitch uniformity. If the filaments separate completely they will have fibrils down each side; if they merely move apart a ladder-like or net-like bundle of interconnected filaments is possible. Complete lateral restraint on a sheet (or even partial restraint on a tape) will thus eventually lead to texturised fibres.

(viii) Splitting Into Filaments

As already stated, usually mechanical work is necessary to separate the filaments. This can be done by (a) in some instances twisting, either false twisting or permanent twisting, (b) by rubbing the tape between two surfaces, especially two rubber surfaces (c) by passing the tape through a venturi air passage (d) by winding the tape over threaded rollers, especially when the rollers are set at an angle to one another, (e) by brushing the stretched tape or (f) by ultrasonic means. This list is illustrative rather than limiting.

The product of the invention will be generally apparent from the above discussion of method and equipment.

Another important aspect of the invention is the production of filaments comprising two or more polymers.

In one version of this one or more preformed films together with the hot melt from the extruder die may be fed into the nip formed by the patterned roller and the chill roller, or the two patterned rollers, as the case may be, so that a composite embossed film is formed having a coating of a different polymer at least from the extruded melt, on one or both sides. Alternatively, a coating of the same polymer, but in a different state, e.g. of orientation, can be utilised. Two or more melts of different polymers may be embossed in a similar manner. For example, high density polyethylene may be coated with low density polyethylene, and this has advantages for heat bonding and texturizing the product. The polymers may also be chosen for texture or colour effects abrasion resistance, coefficient of friction and the method makes it possible to use polymers which are not "cold-drawing", and which could not otherwise be used for deformation and splitting in the process of the invention. When such polymers are formed as a surface coating on the "cold-drawing" polymer they take part in the elongation and splitting which is not part of their normal properties. Examples of polymers which do not fibrillate easily but may be used in this variant include ethylene/vinyl acetate copolymers, ethylene/ethyl acrylate copolymers, polyvinyl chloride and low density polyethylene.

In another version, previously homogenised blends of two or more polymers may be used, provided they will undergo the deformation and splitting required of them, e.g. polypropylene/high density polyethylene blends and polyamide/polyethylene blends.

The filaments produced by stretching the embossed film may be cut into short lengths to form staple fibre, whether or not it has been divided into narrower tapes.

The invention will be further described with reference to the accompanying drawings in which:

FIG. 1 is a diagrammatic representation of equipment for carrying out the present invention, FIG. 2 is a cross section of part of the surface of an embossing roller, FIG. 3 is a view similar to FIG. 2 showing one ridge higher than the others for splitting the filaments into bundles.

Figure 11:
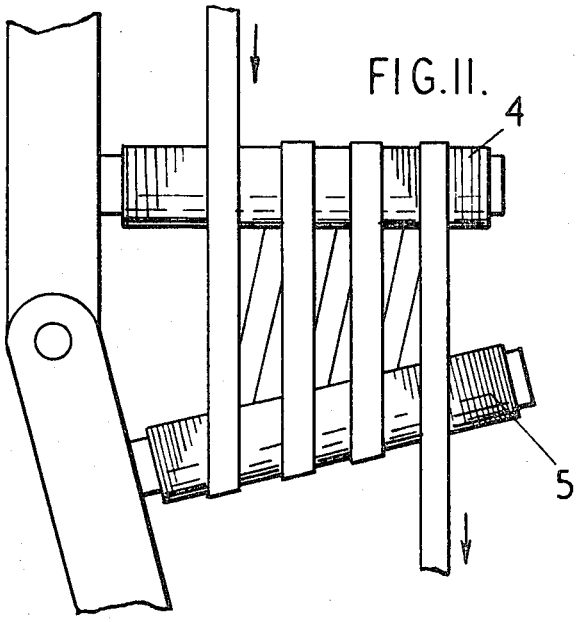
Figure 12:
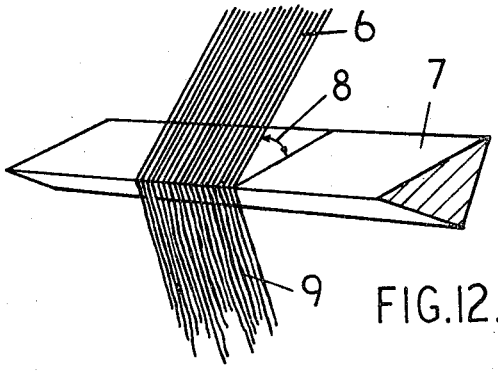
Figure 13:
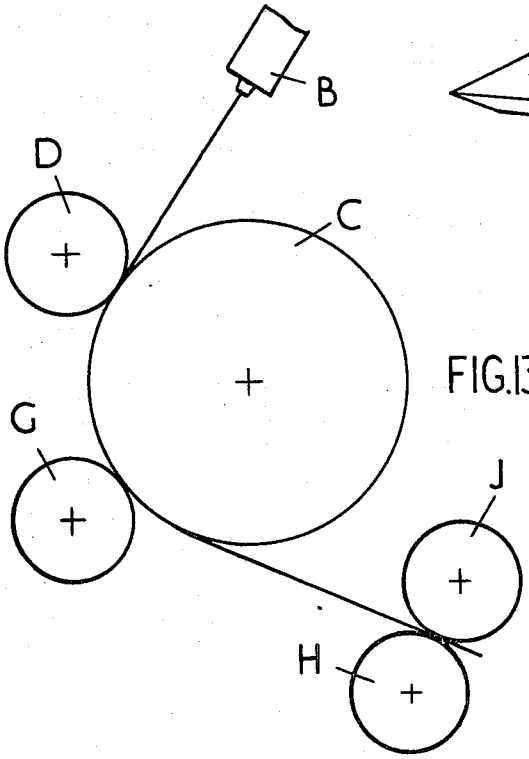

FIG. 4 is an elevation of an embossing roller having ridges engraved with a relief pattern, FIG. 5 is a projection of part of the surface of an embossed sheet having furrows engraved with a pattern, FIGS. 6 (*a*) (*b*) and (*c*) show examples of various cross section of embossed film, FIGS. 7 (*a*) and (*b*) show examples of different cross sections of composite embossed film formed of two different polymers, FIG. 8 is a diagrammatic representation of a textured filament, FIGS. 9 (*a*) (*b*) and (*c*) show examples of different cross sections of textured filament, FIGS 10 to 12 show means to facilitate separation of the ribs after stretching, and FIG. 13 shows in more detail a practical embodiment of the melt embossing stage.

As shown in FIG. 1, the equipment for producing filaments comprises an extruder A for example a Reifenhauses extruder with a 60 mm barrel, a flat film die B, an embossing roller C and a second adjacent roller D which may be a plain chill roller (especially an externally water-cooled rubber roller) or a second embossing roller.

The stages shown diagrammatically at E and F can be a stretching and winding stage, but are not limited to this. For example, E can be a slitting stage and F a stretching stage, or E a stretching and F the separate splitting stage prior to winding. Because these stages in themselves can be conventional, no attempt has been made to demonstrate each combination in detail.

In FIG. 2 the pitch of the grooves is shown as (p) and the depth of the grooves as (d).

The individual pieces of equipment used are in themselves conventional. Examples using polypropylene are as follows.

EXAMPLE I

Polypropylene (Propathene GWE 28) was extruded at a melt temperature of 250° C from a 22 inch flat film die having a die gap of 375μ (15 thousandths of an inch). Approximately 5 inches from the die the flat melt was passed between a nip comprising two 5 inch diameter embossing rollers. Both embossing rollers had 40 annular grooves per cm., the cross section of the grooves was semicircular, radius 4 thousandths of an inch. Both rollers were maintained at 60° C at the surface with internal water circulation. The rollers were mounted with grooves coincident.

The resulting embossed film possessed a cross-section of almost circular ribs joined by a membrane, in which respect it differed slightly from that shown in FIG. 6(*c*). The rib thickness was 200μ and the membrane thickness was 12μ. This film was divided into ½ cm. tapes and stretched at 145° C between two set of nip rollers 4 m apart. The stretch ratio used was 14:1. Almost complete splitting into filaments was observed after stretching, and splitting was complete after twisting into a multifilament yarn.

The resulting 20 filaments comprising the multifilament yarn possessed the following properties Denier/filament: 18.2
Breaking Load/filament(g): 136.6
Tenacity (g/den.): 7.5
Extension (%): 15.8

EXAMPLE II

Polypropylene (Propathene LXF 50) was extruded at a melt temperature of 250° C from a 22 inch flat film die having a die gap of 375μ (15 thousandths). Approximately 4 inches from the die the flat melt was passed between a nip comprising an embossing roller (diameter 5 inch) and a chill roller (diameter 12 inch). The embossing roller surface possessed 40 annular grooves per cm., the cross-section of the grooves was triangular (30° included angle) and the roller was maintained at 70° C. The chill roller surface consisted of a Hypalon rubber coating (65° Shore hardness) and was internally cooled with water at ambient temperature. Additional cooling was provided by doctoring a fine film of water onto the chill roll surface.

Embossed film of total thickness 125μ was produced having 25μ interconnecting membranes between adjacent ribs. This film was divided into ½ cam. tapes and stretched at 145° C between two sets of nip rollers 4 m. apart. The stretch ratio used was 14.1. Subdivision into individual filaments was assisted by passing over finely grooved godet rollers.

The resulting 20 filaments comprising the multifilament yarn possessed the following properties:

Denier/filament: 11.4
Breaking load/filament: (g) 87.4
Tenacity (g/den): 7.7
Extension (%): 15.3

EXAMPLE III

Polypropylene (Propathene LXF 50) was extruded at a melt temperature of 250° C through an 18 inch flat film die having a die gap of 450μ (18 thousandths). The hot melt was passed through a nip situated 5 inches from the die lip. The nip comprised (a) a 5 inch diameter embossing roller having on its surface 40 annular grooves/cm (30° included angle) and internally circulated with water at 75° C, and (b) a 12 inch chrome-plated steel chill roller internally circulated with water at 60° C.

Embossed film was produced having a thickness of 235μ and interconnecting membranes between ribs of 52μ thickness. This film was slit into 6.25 mm tapes and subjected to a 10:1 stretch ratio at 150° C between two sets of nip rollers spaced 4 meters apart. Sub-division into the 25 individual filaments was assisted by passing the stretched tape through an air venturi.

The resulting filament properties were as follows:

Denier/filament: 25.6
Breaking load/filament (g): 175.3
Tenacity (g/denier): 6.8
Break extension (%): 18.8

The splitting apart of the ribs of the sheet, if necessary, can be facilitated by the expedients shown in FIGS. 10, 11 and 12.

FIG. 10 shows a tape, stretched to its full extent and optionally twisted and split to some extent being passed through passage 1 into an air venturi 2 where a flow of air in the direction of arrow 3 subdivides the filaments.

FIG. 11 shows the stretched sheet, subdivided into tape being passed to and fro over rollers 4 (having, e.g. 100 grooves per inch) and 5 (having, for example, 200 grooves per inch). The rollers are angled with respect to one another.

FIG. 12 shows a tape 6 subdivided from a stretched sheet being passed over a sharp edge 7 (optionally heated) at an angle 8 (lying on the surface of the sharp edge 7) so that shear is produced between the ribs and the ribs separate as filaments 9. Of course, the intermediate product where the ribs are not fully split apart is also a feature of this invention.

FIG. 13 shows an embodiment of the embossing step where more than one embossing roller is used.

In this embodiment as extruded sheet from extruder B passes between primary embossing roller D and chill roller C then, while still in contact with roller C (and accordingly still accurately located) between roller G and roller C. Roller G is provided with circular ridges to subdivide the sheet into tapes. Thereafter, if desired, the sheet can pass between drawing rollers H and J.

Of course, roller C could itself provide an embossment on the reverse side of the sheet and/or roller G could provide secondary grooves on the roller D embossing to texturise the fibre produced. Rollers H and J could then be splitting rollers. A feature of this variant is that the sheet is located on the main roller so as to permit more than one precise operation upon the sheet prior to stretching.

In yet another variant it will be appreciated that the rollers D and G may each provide melt-embossing, whether or not C is itself grooved or otherwise patterned, provided that the rate of cooling at rollers D and C is not too great. A secondary embossing with one of the rollers G, J or H heated is also possible.

To summarise, therefore, important types of variant sheet pattern which can be made within the scope of the invention, there are:

(a) Sheets with grooves and/or ridges on one face and parallel to the edges. For a given roller, the ridges can be flattened, if the sheet is too thin to be pressed down into the roller grooves, or more rounded if a thicker sheet is used.

(b) Sheets embossed with longitudinal grooves on both sides either coincident or out-of-phase. These can be made by opposing grooved rollers, or be made sequentially as shown in FIG. 13.

(c) Sheets with shallow transverse grooves on the tops of the ridges or bottoms of the longitudinal grooves, to provide textured fibres or easier splitting respectively.

(d) Sheets as in any of the above made of two or more polymers, either in separate layers or as, for example, homogeneous blends.

EXAMPLE IV

Polypropylene, as above, was extruded from an extruder of 1½ inch diameter, length-to-diameter ratio 24:1 and barrel temperatures of 425° F, 475° F and 525° F in three successive zones leading to a 6 inch width die lip at the same temperature (525° F) as the third barrel zone.

The molten film was extruded downwards over a distance of 7 centimeters (about 3 inches) into the nip between (a) a 9 inch diameter "embossing" roller, made of bronze, with 75 circumferential grooves of 60° included angle per inch and (b) a 9 inch diameter smooth "backing" roller made of stainless steel. The "embossing" roller was run at 195° F, and the "backing" roller at 375° -395° F, with the peripheral speed in both instances being 34 feet per minute. The applied pressure was about 320 lbs. (i.e. about 160 lbs on each roller, and since this was applied over a film approximately six inches wide, represented about 50 lbs per linear inch of nip.

The solidified and embossed film was drawn off around the "embossing roller" and split by cutting blades into "tapes" each having 25 ribs corresponding to 25 grooves, i.e. ⅓ inch, of the roller surface. These tapes were then passed over three successive godets (heating being effected by an infra-red oven) at peripheral speeds of 35,280 and 267 ft./min. and temperatures of ambient, 250– 260° F, and ambient respectively thus providing an 8:1 stretch and subsequent relaxation.

The stretched tapes which already exhibited fibrillation and separation along the bottom of the grooves, were passed through an air venturi at 40 p.s.i. to give a product which was at least 95% fibrillated.

The denier of tape immediately prior to separation of the filaments (and hence the denier of any yarn to be spun from the bundle of 25 filaments) was 575, i.e. corresponding to a filament denier of about 23. In appearance the filaments were smooth and regular in appearance, with a tenacity of 6.4 gm./den. and an extension of 29.5%.

EXAMPLE V

A generally similar run was carried out except that instead of the 75 grooves-per-inch bronze roller there was used a 100 grooves-per-inch steel roller. The physical characteristics of the product were 94% fibrillation, 5.6 – 6.1 gm./den. tenacity and 16.6 filament denier.

We claim:

1. A process for the production of continuous filaments comprising passing a molten deformable polymeric material as a formed flat hot melt sheet into the nip formed between (a) at least one roller having a multiplicity of adjacent fine continuous circumferential grooves and (b) a second roller in pressure contact therewith, at least one of said rollers being maintained at a temperature below the temperature of the molten deformable polymeric material to effect cooling and simultaneously form and solidify said material into a flat body of material having parallel continuous ribs along its longitudinal axis; stretching the ribbed material in a direction substantially parallel to the ribs by an amount sufficient to orient the polymer; and splitting the material longitudinally between the ribs to form longitudinal filaments corresponding to said ribs.

2. A process as claimed in claim 1 in which the material is extruded as a sheet and thereafter slit into tapes at any stage within the period extending from before embossing to after stretching.

3. A process as claimed in claim 1 in which the material splits into filaments spontaneously on stretching.

4. A process as claimed in claim 1 in which the material is subjected to transverse stresses to split it into filaments.

5. A process as claimed in claim 1 wherein the polymer is a cold-drawing polymer.

6. A process as claimed in claim 5 wherein the polymer is polypropylene.

7. A process as claimed in claim 6 wherein polypropylene is extruded at 200° to 300° C.

8. A process as claimed in claim 1 wherein an extruded sheet is passed through the nip between a single circumferentially grooved roller and a smooth roller.

9. A process as claimed in claim 1 wherein an extruded sheet is passed through the nip between two circumferentially grooved rollers in pressure contact.

10. A process as claimed in claim 9 wherein the grooves on each roller are located coincidentally.

11. A process as claimed in claim 1 where the roller possesses from b 10 to 300 longitudinal grooves per inch.

12. A process as claimed in claim 1 wherein the grooves are semicircular in cross-section and wherein two coincidentally grooved opposed rollers are used.

13. A process as claimed in claim 1 wherein the sheet leaving the roller is from 0.001 to 0.02 inches thick overall.

14. A process as claimed in claim 13 where the material between the ridges of the sheet is less than 50% of the thickness of the sheet overall.

15. A process as claimed in claim 14 where the material between the ridges is less than 25 microns thick.

16. A process as claimed in claim 2 wherein an extruded sheet is subdivided into tapes immediately after leaving the die.

17. A process as claimed in claim 2 wherein an extruded sheet is subdivided into tapes by roller ridges while passing through the nip of embossing rollers.

18. A process as claimed in claim 2 wherein the sheet is subdivided into tapes after leaving the embossing roller.

19. A process as claimed in claim 18 wherein subdivision is effected before stretching.

20. A process as claimed in claim 1 where stretching is effected up to 2000% of the unstretched length.

21. A process as claimed in claim 20 wherein the polymer is polypropylene and is stretched at 130° – 155° C.

22. A process as claimed in claim 1 wherein a sheet is stretched with no lateral restraint.

23. A process as claimed in claim 1 wherein a sheet is stretched with complete lateral restraint.

24. A process as claimed in claim 1 wherein the individual filaments are split apart by twisting the stretched material.

25. A process as claimed in claim 1 wherein the individual filaments are split apart by passing a tape of the stretched material through an air venturi passage.

26. A process as claimed in claim 1 wherein the individual fibres are split apart by winding a tape of stretched material over grooved godet rollers positioned at an angle to one another.

27. A process as claimed in claim 1 wherein the extruded material is coated on one or both sides with a preformed polymer sheet before being melt-embossed.

28. A process as claimed in claim 27 wherein a non-cold-drawing polymer is used as the preformed polymer sheet.

* * * * *